United States Patent [19]

Vosskötter

[11] Patent Number: 5,052,079

[45] Date of Patent: Oct. 1, 1991

[54] PIVOTED FITTING OR TURN-AND-TILT FITTING FOR WINDOWS, DOORS

[75] Inventor: Alfred Vosskötter, Münster, Fed. Rep. of Germany

[73] Assignee: Aug. Winkhaus GmbH & Co. KG

[21] Appl. No.: 396,564

[22] Filed: Aug. 18, 1989

[30] Foreign Application Priority Data

Aug. 26, 1988 [DE] Fed. Rep. of Germany ..... 3829053

[51] Int. Cl.[5] ..... E05D 3/10; E05D 15/00; E05D 15/52

[52] U.S. Cl. ..... 16/367; 16/369; 49/192

[58] Field of Search ..... 16/233, 310, 358, 364, 16/367, 368, 369, 370, 360; 49/192

[56] References Cited

U.S. PATENT DOCUMENTS

| | | | |
|---|---|---|---|
| 748,670 | 1/1904 | Vandever | 16/310 |
| 1,193,204 | 8/1916 | Taylor | 16/368 |
| 1,888,345 | 11/1932 | Cummings . | |
| 1,920,898 | 8/1933 | Soule | 16/360 |
| 3,509,663 | 5/1970 | Miller . | |
| 4,035,953 | 7/1977 | Bierlich . | |

FOREIGN PATENT DOCUMENTS

| | | | |
|---|---|---|---|
| 0204267 | 5/1986 | European Pat. Off. . | |
| 329280 | 11/1920 | Fed. Rep. of Germany . | |
| 2113665 | 10/1972 | Fed. Rep. of Germany . | |
| 3223451 | 12/1983 | Fed. Rep. of Germany . | |
| 3442364 | 11/1984 | Fed. Rep. of Germany . | |
| 3601278 | 7/1987 | Fed. Rep. of Germany . | |
| 2497864 | 7/1982 | France . | |
| 2550576 | 2/1985 | France . | |
| 8705963 | 10/1987 | PCT Int'l Appl. . | |
| 997936 | 7/1965 | United Kingdom | 16/360 |
| 1347492 | 2/1974 | United Kingdom . | |
| 1352675 | 5/1974 | United Kingdom . | |
| 2086970 | 5/1982 | United Kingdom . | |

*Primary Examiner*—Robert L. Spruill
*Assistant Examiner*—Carmine Cuda
*Attorney, Agent, or Firm*—Toren, McGeady & Associates

[57] ABSTRACT

A pivoted fitting or turn-and-tilt fitting for windows, doors or the like comprises a bottom turn-and-tilt bearing and a top pivot bearing, both bearings being in each case constructed with two links in order to shift the pivot axis during pivoted opening of the leaf frame. In order to relieve the links of the weight of the leaf, it is suggested that the leaf frame be supported on the fixed frame via an arrangement which is independent of the links of the two pivot bearings.

34 Claims, 5 Drawing Sheets

Fig. 1
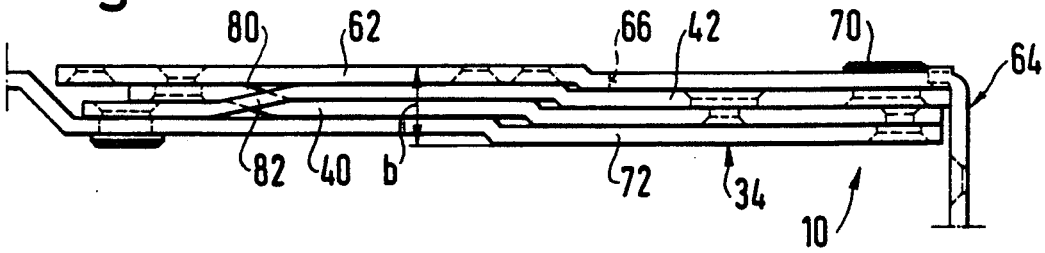
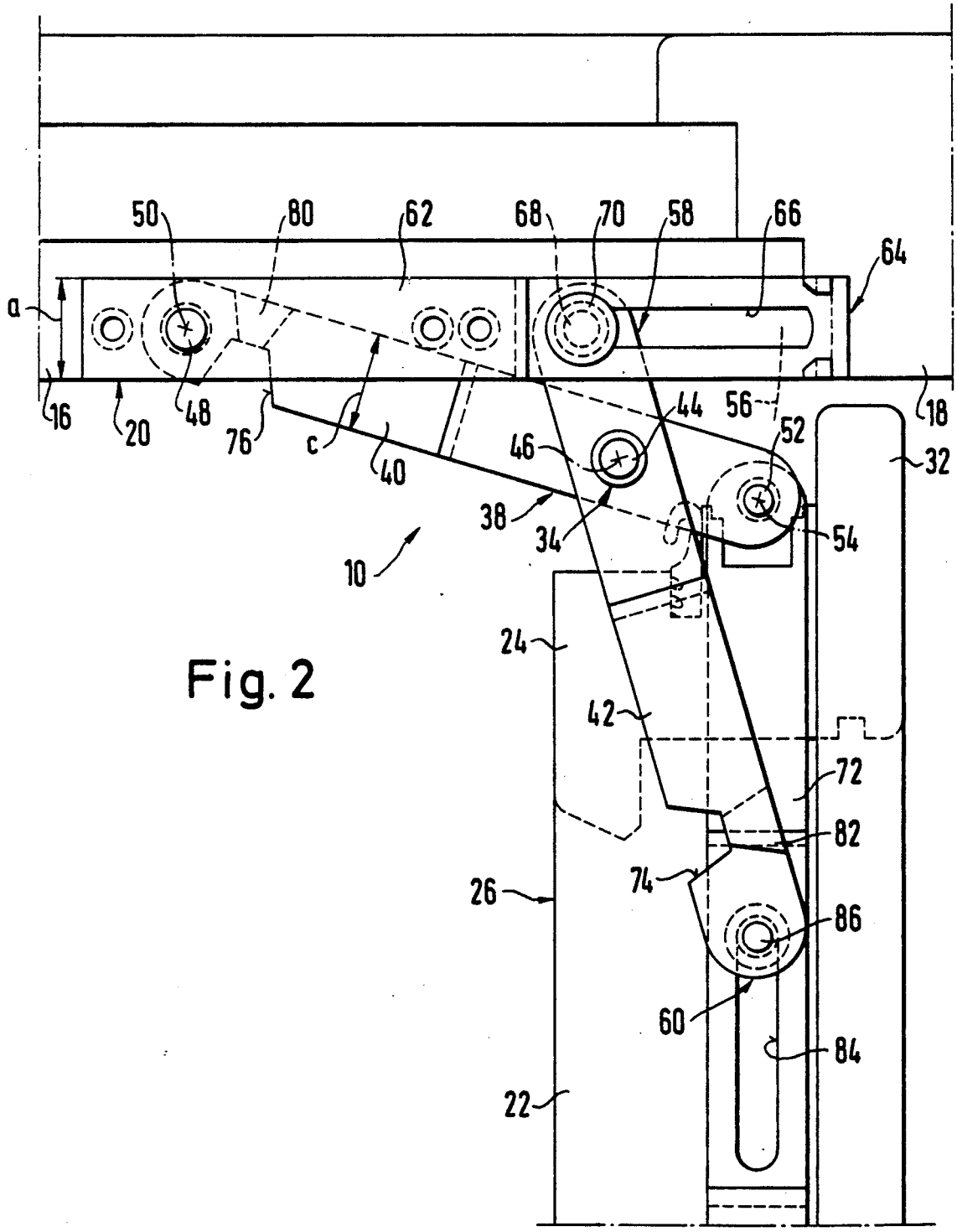
Fig. 2

PIVOTED FITTING OR TURN-AND-TILT FITTING FOR WINDOWS, DOORS

DESCRIPTION

1. Field of the Invention

The invention relates to a pivoted fitting or tilt-and-turn fitting for windows, doors or the like with a fixed frame and a leaf frame which is mounted on the fixed frame to rotate about a vertical pivot axis and possibly to be tiltable about a horizontal tilting axis, comprising a bottom pivot bearing, possibly in the form of a turn-and-tilt bearing, which connects the fixed frame with the leaf frame in the region of a bottom corner of the fixed frame, an upper pivot bearing which connects the fixed frame to the leaf frame or to a stay coupled with the leaf frame, in the region of an upper corner of the fixed frame, the two pivot bearings being in each case constructed with at least two links so that when the leaf frame is pivoted open the pivot axis is shifted in a direction at right-angles to the plane of the fixed frame.

2. Description of the Prior Art

Such a fitting is known (DE-B2-21 13 665, DE-C1-34 42 364, DE-A1-36 01 278, EP-A2-204 267, DE-A1-32 23 451, U.S. Pat. No. 1,888,345). By virtue of the link construction provided on the upper and lower pivot bearings, it is ensured that when the leaf frame is pivoted open, the pivot axis is shifted to in front of the fixed frame, so that during pivoted opening a leaf overlap of the leaf frame which, when the leaf frame is closed, masks the space between the fixed frame and the leaf frame, cannot collide with the fixed frame. At the same time, when the leaf frame is closed, all the fitting parts can be accommodated in the fillister space so that they are concealed by the leaf overlap, ensuring a pleasing outward appearance. A disadvantage of the known constructions, however, is particularly the fact that the links are exposed to considerable bending stresses, particularly if the leaves are weighty. The links may become bent, resulting in difficulty and, in certain cases, functional inefficiency in the fitting. One might imagine constructing the links and the articulating connections accordingly more stable mechanically but this would lead to an increase in the space required for installation.

SUMMARY OF THE INVENTION

One object of the invention is to provide a fitting being of compact construction, and ensuring reliable functioning even in the case of heavier leaves.

This problem is resolved in that the leaf frame, particularly the leaf frame which has been pivoted to an open position, is supported on the fixed frame via a device which is independent of the links of the two pivot bearings.

Particularly in the case of a purely pivoted fitting, this device should consist of an element acting between the leaf frame and the fixed frame and exposed to a tensile stress. However, it is preferable for the device to comprise a bracing bar braced at one end on the fixed frame in the region of the bottom pivot bearing and at the other on that frame member of the leaf frame which is parallel with the axis of rotation and which is close to the pivot bearing. The compression-loaded bracing bar, when the window is pivoted into an open position, conveys the leaf forces into the bottom corner bearing, correspondingly relieving the links of the two pivot bearings. In the case of the particularly preferred turn-and-tilt fitting, the bracing bar can without being altered, be retained also for the tilting opening of the leaf.

Preferably, the bracing bar is supported on an angled-over bracing lug on a corner bearing part on the frame side, preferably on the vertical member of a corner bearing angle which is on the frame side. In the case of a turn-and-tilt fitting, a particularly simple construction is assured in that the bracing bar is tiltably mounted on the bracing lug. Then, the bracing bar can easily perform the tilting movement of the leaf.

By reason of the fact that when the leaf frame is closed, the bracing lug is, in the direction of the pivot axis, opposite an extension piece disposed in the region of the corresponding bottom corner of the leaf frame, there is a safeguard against lift-out, when the leaf is in the tilted position. In fact, if an attempt is made to lift out the leaf in the region of the corner bearing, then the extension piece immediately comes to bear on the bracing bar.

Simple construction, particularly in the case of conventional fittings with a face plate, is guaranteed by the measures whereby the bracing bar is braced on an angle member which is preferably mounted on a leaf frame face plate.

To adjust the leaf frame (bracing bar), it is preferably envisaged that the angle member be constructed to be adjustable in a direction parallel with the pivot axis and for the angle member to be braced on a setscrew. In order easily to allow the tilting movements of the bracing bar in relation to the leaf frame. Such as occur during pivoting or tilting of the leaf to open it, it is envisaged that the angle member be rotatably mounted.

By reason of the fact that the bracing bar is captively and preferably substantially rigidly mounted on the angle member, a preassembled unit is made available consisting of a bracing bar, angle member and possibly a face plate, with no risk of the bracing bar being lost.

Furthermore, it is suggested that the bracing bar be provided at its bottom end with a journal adapted to be inserted into a bore in the bracing lug and which preferably tapers conically towards the journal end.

These measures permit on the one hand of facilitated leaf assembly since to this end the bracing bar premounted on the leaf frame only has to be inserted into the bore in the supporting lug; on the other, the preferred conical tapering of the journal end guarantees that the bracing bar can carry out the necessary tilting movements during pivoted opening or tilted opening of the leaf in relation to the bracing lug rigid with the frame.

Upon pivoted opening of the leaf, the top end of the bracing bar performs as pivoting movement about the bottom supporting point which is rigid with the frame. In order hereby to achieve the least possible lowering of the top end of the bracing bar and thus of the leaf frame when the leaf is pivoted into an open position, it is suggested that the bracing bar be supported somewhere on the bottom pivot bearing, possibly on the supporting lug, this location being offset in a direction of the leaf frame and out of a median plane through the bottom pivot bearing which is parallel with the plane of the fixed frame. By virtue of this offset of the point of support, there is at the commencement of the opening movement a slight lifting of the frame until the bracing bar is vertical; during the course of the further opening movement, the leaf frame is slightly lowered.

When closing the leaf, in order to have a well-defined link movement with possibly a high closure pressure, it is known (DE-B2-21 13 665) for both links to intersect and to be articulatingly connected to each other by a universal joint at the point of intersection, one of the two links, the guide link, being connected to a pivot bearing part on the fixed frame side and to a pivot bearing part, possibly a stay, on the leaf frame side, in each case via a swivel joint, while the other link, the control link, is connected to the pivot bearing part on the fixed frame side and to the pivot bearing part, possibly a stay, on the leaf frame side, in each case via a sliding swivel joint. However, in the case of the prior art fitting, this results in twice the installation depth being required in the fillister space (in a direction at right-angles to the plane of the leaf frame). In the case of this known arrangement, so that the various joints do not come into mutual conflict, the joints on the fixed frame side are offset into the fillister space in relation to the joints on the leaf frame side (FIG. 1).

With such a fitting, in order to provide for a compact construction, particularly a minimal installation depth for the fitting, it is suggested that when the leaf is closed, all the swivel joints and sliding swivel joints lie at least approximately in a plane parallel with the plane of the frame and that the control link, in the region between the universal joint and one of the two swivel joints, be provided with a crank in a direction of the pivot bearing part carrying the respective pivot joint and corresponding to the thickness of the guide link, and it is further suggested that the guide link likewise be constructed with a crank corresponding to the thickness of the control link but in the opposite direction which, when the leaf is closed, lies at a direction at right-angles to the plane of the frame alongside the crank in the control link. These features can be used in addition to or even independently of the aforedescribed measures in conjunction with the bracing device. By virtue of the cranked construction according to the invention, the two joints following the cranked shape—swivel joint and sliding swivel joint—can be disposed above each other (in a direction parallel with the plane of the frame and at right-angles to the longitudinal directions of the links); thus, they can also lie in a plane parallel with the plane of the frame which admits of a correspondingly narrow construction of the link arrangement with a minimal installation depth.

The measure whereby at least one of the two links, preferably both links, is provided in the region of the relevant crank with a recess open in a direction at right-angles to the plane of the frame, to accommodate whichever is the other link, also helps to achieve this. Except for the two recesses, the two links are of a width which corresponds essentially to the desired installation depth (at right-angles to the plane of the frame) and are thus adequately stable.

A negligible crank, corresponding to the thickness of a bearing bolt head, is obtained in that the pivot bearing part on the fixed frame side is in the region of its sliding swivel joint provided with a crank corresponding to the thickness of a bearing bolt head and in that the control link as well as the guide link are in each constructed with a substantially equivalent crank. Thus, space is provided to allow movement of the bearing bolt head without having to carry out any routing on the leaf frame.

Simplified assembly of the leaf on the fixed frame is guaranteed in that, in the case of a turn-and-tilt bearing (corner bearing) in the region of the end of the control link which is on the leaf frame side, and/or of the guide link, a drive journal is provided which engages a corresponding journal housing aperture in a carrier part on the leaf frame side. Therefore, the link joint can be completely free mounted on the leaf frame. Then the leaf frame can be fitted onto the journals.

A conical tapering of the drive journal readily permits the tilting movement of the leaf without the need for any tiltable riveting such as is known, for instance, from DE-A1-36 01 278, with the disadvantage of difficult manufacture to achieve corresponding precision.

To adjust the position of the leaf frame in a horizontal direction parallel with the plane of the leaf frame and relative to the fixed frame, it is suggested that the carrier part on the leaf frame be constructed to be adjustable in a direction parallel with the bottom horizontal leaf frame member. Preferably, there is rigidly mounted on the leaf frame corner an abutment angle member, the horizontal leg of which is constructed with a sliding guide for the carrier part while its vertical leg is braced via a setscrew on an extension piece of the carrier part.

BRIEF DESCRIPTION OF THE DRAWINGS

The invention is explained in greater detail hereinafter with reference to a preferred example of embodiment shown in the accompanying drawings, in which:

FIG. 1 is a side view of an upper pivot bearing with a stay and with the leaf closed;

FIG. 2 is a plan view of the arrangement shown in FIG. 1 with the leaf pivoted into an open position;

DESCRIPTION OF THE PREFERRED EMBODIMENTS

Figure 3:
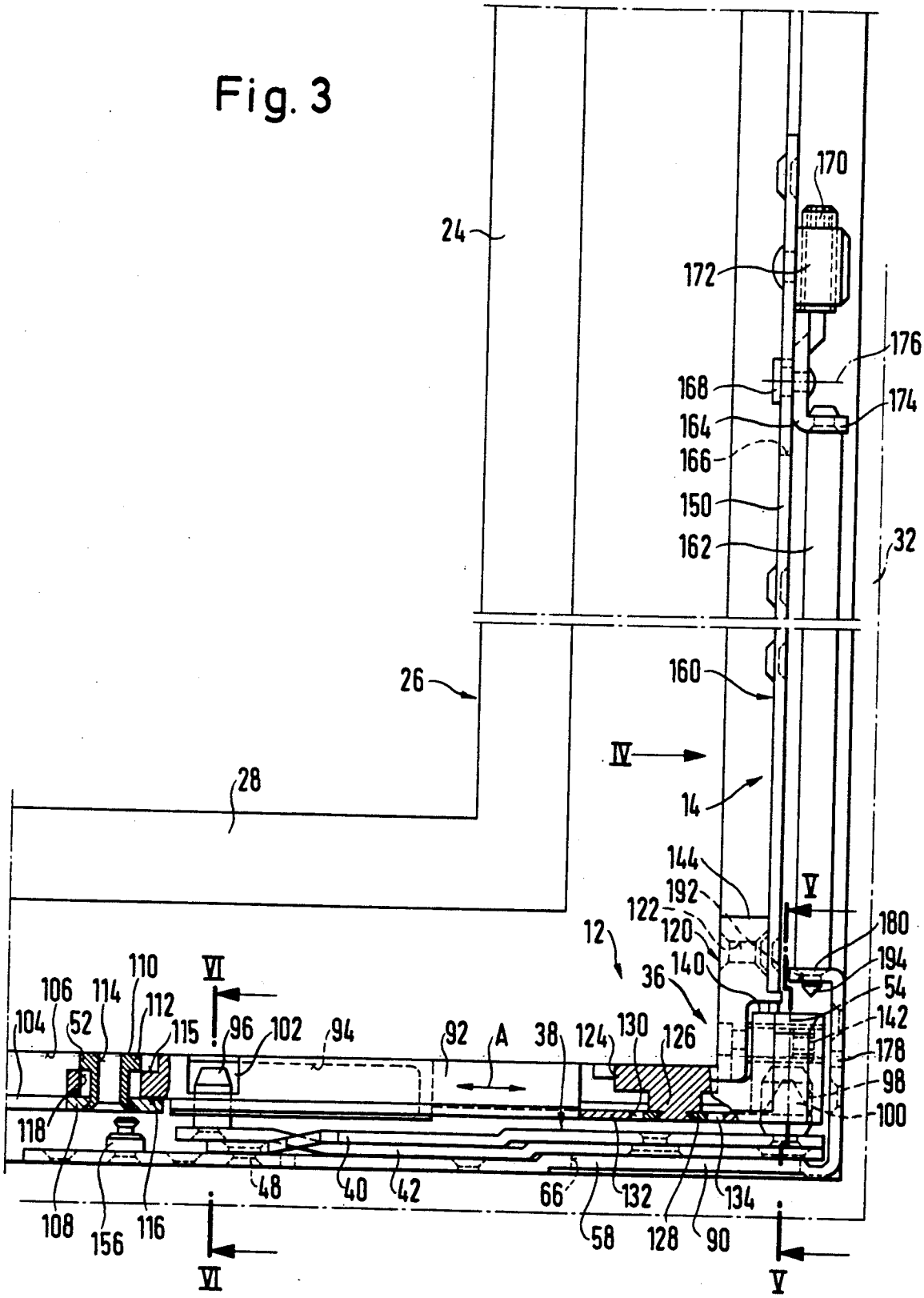
FIG. 3 is a partly sectional side view of a corner bearing together with a bracing device.

The turn-and-tilt fitting to be described hereinafter with reference to the drawings consists of an upper pivot bearing 10 shown in FIGS. 1 and 2, a bottom pivot bearing described hereinafter as a corner bearing 12 and which serves at the same time as a tilting bearing, and a bracing device 160 for relieving the pivot bearing 10 and the corner bearing 12, particularly in the case of a leaf which is rotated or tilted into an open position. FIG. 2 shows an upper horizontal member 16 and a vertical member 18 on the pivot axis side and part of a fixed frame 20. Also shown is an upper horizontal member 22 and, close to the pivot axis, a vertical member 24 of a leaf frame 26. A bottom horizontal member 28 of the leaf frame and a bottom horizontal member 30 of the fixed frame 20 are shown in section in FIGS. 5 and 6. An encircling leaf frame overlap 32 which, when the leaf is closed, masks all the fitting parts so that they are outwardly invisible, can be seen in FIGS. 2, 4, 5 and 6 and is indicated in FIG. 3 by a dash-dotted line.

When the leaf frame 26 has been pivoted into an open position, the overlap 32 which bears on the fixed frame 20 or is at a slight distance therefrom does not, in the region of the vertical pivot axis, abut the fixed frame 20, both the upper pivot bearing 34 shown in FIGS. 1 and 2 and also the bottom corner bearing 36 is provided with an identically constructed link joint 38.

Each link joint 38 consists of a guide link 40 and a control link 42 which are connected to each other by a simple pivot joint with a vertical pivot axis 46 and referred to hereinafter as a universal joint 44. The guide link 40 is connected to the fixed frame 20 via a swivel joint 48 with a vertical axis 50 and to the leaf frame 26 likewise via a swivel joint 52 with a vertical axis 54. The axis 54 can be described as the pivot axis of the leaf 26; when the leaf 26 is pivoted into an open or closed position, the axis of rotation moves along an arc 56 located in the horizontal plane and about the axis 50.

The control link 42, on the other hand, is coupled in each case via a sliding swivel joint 58 or 60 to the fixed frame 20 or the leaf frame 26. In the case of the upper swivel joint 10, there is in the horizontal member 62 of a screw-on angle 64 mounted on the fixed frame an elongated hole 66 which is parallel with the longitudinal direction of the upper horizontal member 16 of the fixed frame 20 and which extends into the region of the bend in the screw-on angled member 64 and receives a guide bolt 68. This projects from the top of the control link 42 and has a bolt head 70 which engages over the longitudinal edges of the elongated hole 66. As FIGS. 1 and 2 show, that portion of the arm 62 of the screw-on angle member 64 which is constructed with the elongated hole 66 is downwardly cranked according to the thickness of the bolt head 7. In the frame rebate in a peripheral face of the fixed frame 20, therefore, there is no need to provide any routing to accommodate the bolt head 70 which is displaceable along the elongated hole 66.

In order to obtain the compact construction of the upper swivel joint shown in FIGS. 1 and 2, with the link joint 38, with minimal installation depth a (see FIG. 2), and installation height b (see FIG. 1), the closely superposed links 40 and 42 and, in the case of the pivot bearing 10, also a stay 72 connected to the links on the leaf frame side are provided with corresponding cranks. Furthermore, the guide link 40 in the region between universal joint 44 and pivot joint 48 is provided with a laterally open recess 76 and with a crank 80 in this region corresponding to the thickness of the material of the two links 40 and 42 so that when the leaf is closed, the control link 42 which is provided with a corresponding laterally open recess 74 as well as a crank 82 in the same area but where the crank is in the opposite direction, moves into a position parallel with the guide link 40. When this happens, the two recesses 74, 76, the depth of which corresponds essentially to half the link width c, engage into each other so that in plan view the two links are coincident. In the side view shown in FIG. 1, by reason of this construction, the sequence of guide and control links is interchanged adjacent to the cranks 80, 82. The installation depth a consequently corresponds to the guide link width c.

The sliding swivel joint 60 on the stay 72 is constructed with an elongated hole 84 extending in the longitudinal direction of the stay, in which elongated hole 84 a guide bolt 86 which is rigidly connected to the control link 42 is guided for longitudinal displacement.

When the closed leaf is pivoted into an open position, the control link 42 ensures that the guide link 40 and thus also the pivot axis 54 assumes a precisely defined position in space at one definite angle of pivoted opening. Upon pivoted closure of the leaf, it is possible by reason of this positive control of this guide link 40 also to achieve relatively high closure forces as required.

If the aforedescribed fitting is constructed as a turn-and-tilt fitting, then for tilting-opening of the window, the stay 72 which is rigidly fixed on the leaf when the leaf is closed or pivoted into an open position is released, so that it can be pivoted out of the plane of the leaf frame and up to a maximum angle of opening. As shown for example in FIG. 3 of DE-AS No. 21 13 665, the end of the stay 72 which is on the leaf frame side can for this purpose be movably mounted in a sliding pivot guide 6 on the leaf frame, the angle of opening being limited by an auxiliary arm 3.

Figure 5:
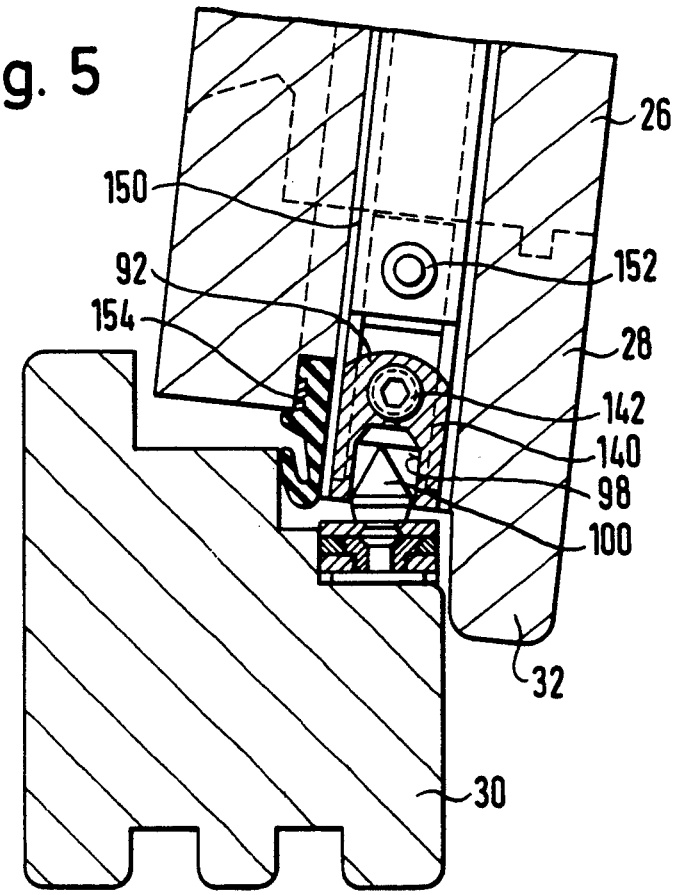
FIG. 5 is a detailed section on the line V—V in FIG. 3.
Figure 6:
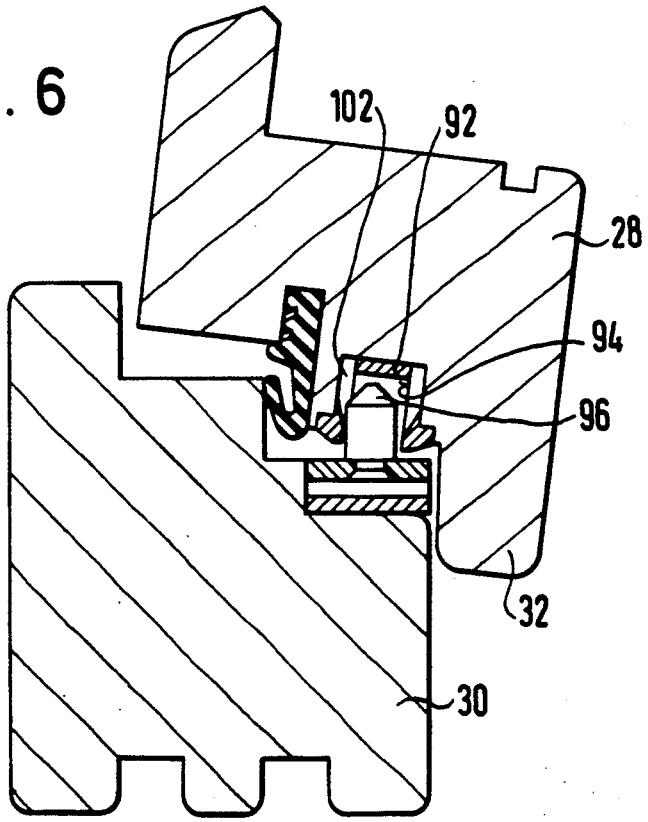
FIG. 6 is a detailed section on the line VI—VI in FIG. 3.

In principle, the construction of the corner bearing 12 in relation to the link joint 38 there corresponds to the development described hereinabove with reference to FIGS. 1 and 2. This ensures that the pivot axis 54 of the leaf defined by the two link joints 38 (swivel joint of the guide link 40 on the leaf frame side) remains vertically orientated or is always displaced parallel. Instead of the screw-on angle member 64, a corner bearing angle 90 is now used which has a swivel joint 48 for the guide link 40 and sliding swivel joint 58 (elongated hole 66) for connection to the control link 42. Instead of the stay 72, there is a carrier part constructed with an elongated hole-recess 94 to accommodate a drive journal 96 projecting from the control link 42 and a bore 98 to accommodate a second drive journal 100 projecting from the guide link 40. The guide journal 100 is sharply and conically tapered in an upwards direction in order to allow a tilting-opening of the leaf (FIG. 5). The entraining or drive journal 96 is at its free end just conically pointed to facilitate insertion into the elongated hole recess 94 when the leaf is assembled. For the rest, it is cylindrically shaped to ensure a solid mechanical guidance within the elongated hole recess 94 when the leaf is pivoted into an open position. In order furthermore to allow a tilting-opening of the leaf, the elongated hole recess 94 is at its end remote from the pivot axis 54 so widened laterally that lateral windows 102 are constructed. Upon a tilting-opening of the leaf, the drive journal 96 penetrates at least partially into one of the two windows 102 (FIG. 6).

The carrier part 92 can be constructed to be displaceable on the leaf frame 26 in a horizontal direction parallel with the leaf frame plane (double-headed arrow A in FIG. 3), in order to adjust a fillister gap between vertical frame members of the fixed frame and of the leaf frame. For this purpose, the carrier part 92 is in the region of its end which is remote from the pivot axis displaceably fixed to a bracing member 52 rigid with the leaf frame. The bracing member 52 consists of a plate 108 disposed in an outer groove stage 104 of a correspondingly staged or stepped groove 106 in the leaf frame, the plate 108 being riveted to a reduced-diameter spacer bolt 110 with an upwardly adjacent enlarged-diameter collar 112. The spacer bolt 110 is provided with a through-bore 114 into which it is possible to insert a fixing screw not shown in FIG. 3. The carrier part 92 is in the region of the bracing member 52 provided with mutually parallel recesses 115 and 116 on the top and respectively bottom of the carrier part 92 to accommodate the enlarged-diameter collar 112 or plate 108. The bolt 110 is mounted for displacement in the direction of the double-headed arrow A in an elongated hole 118 extending between the two recesses 115, 116.

Furthermore, the carrier part 92 is mounted for displacement in the direction A on an abutment angle member 120 which overlaps the corresponding corner of the leaf frame on which it is rigidly screwed (through-bore 122 for a fixing screw not shown). A projection 126 protruding downwardly from the horizontal member 124 of the abutment angle member 122 serves as a linear guide for the carrier part 92. To this end, it is for example riveted at its bottom end to an enlarged-diameter ring 128. This ring 128 passes through an elongated hole 130 in a bottom 132 of the carrier part 92 which is trough-shaped in this area. Furthermore, the ring 128 has its upper surface bearing on the underside of two webs 134 which extend along the longitudinal edges of the elongated hole.

At its end which is in the region of the pivot axis 54, the carrier part 92 is constructed with an upwardly projecting extension piece 140, which accommodates both the already mentioned downwardly open bore 98 while at the same time co-operating with a horizontally extending adjusting screw 142 (indicated by broken lines in FIG. 3), which is also braced on the vertical member 144 of the abutment angle member 120. The adjusting screw 142 can, for example, be rotatably but axially immovably fixed on the vertical member 144, its external screwthread co-operating with an internal screwthread provided in the extension piece. A rotation of the adjusting screw 142 results in a corresponding displacement of the carrier part 92 in one or other direction (double-headed arrow A).

If a face plate 150 is used on the vertical member 24 of the leaf frame 26 which is close to the pivot axis, the face plate being laid in an outer step 104 of the groove, then its bottom end can be bolted directly to the vertical member 144 of the abutment angle member 120. For this purpose, a fixing screw 152 shown in FIG. 5 can be used and passes through both the face plate 150 and also the vertical member 122. FIG. 5 also shows the adjusting screw 142 as well as the bore 98 which receives the journal 100 when the leaf is tilted into the open position. An encircling seal 154 provided on the leaf frame ensures sealing-tightness between leaf frame and fixed frame when the leaf is closed.

Correspondingly, FIG. 6 shows how, when the leaf is tilted open, the journal 96 partially enters one of the two windows 102.

An upwardly projecting journal 156 indicated in FIG. 3 at the left-hand end of the corner bearing angle 90 can be connected to a stay rod provided between the fixed frame and the leaf frame and limiting the angle of pivoted opening, the journal then serving as a catch.

Figure 4:
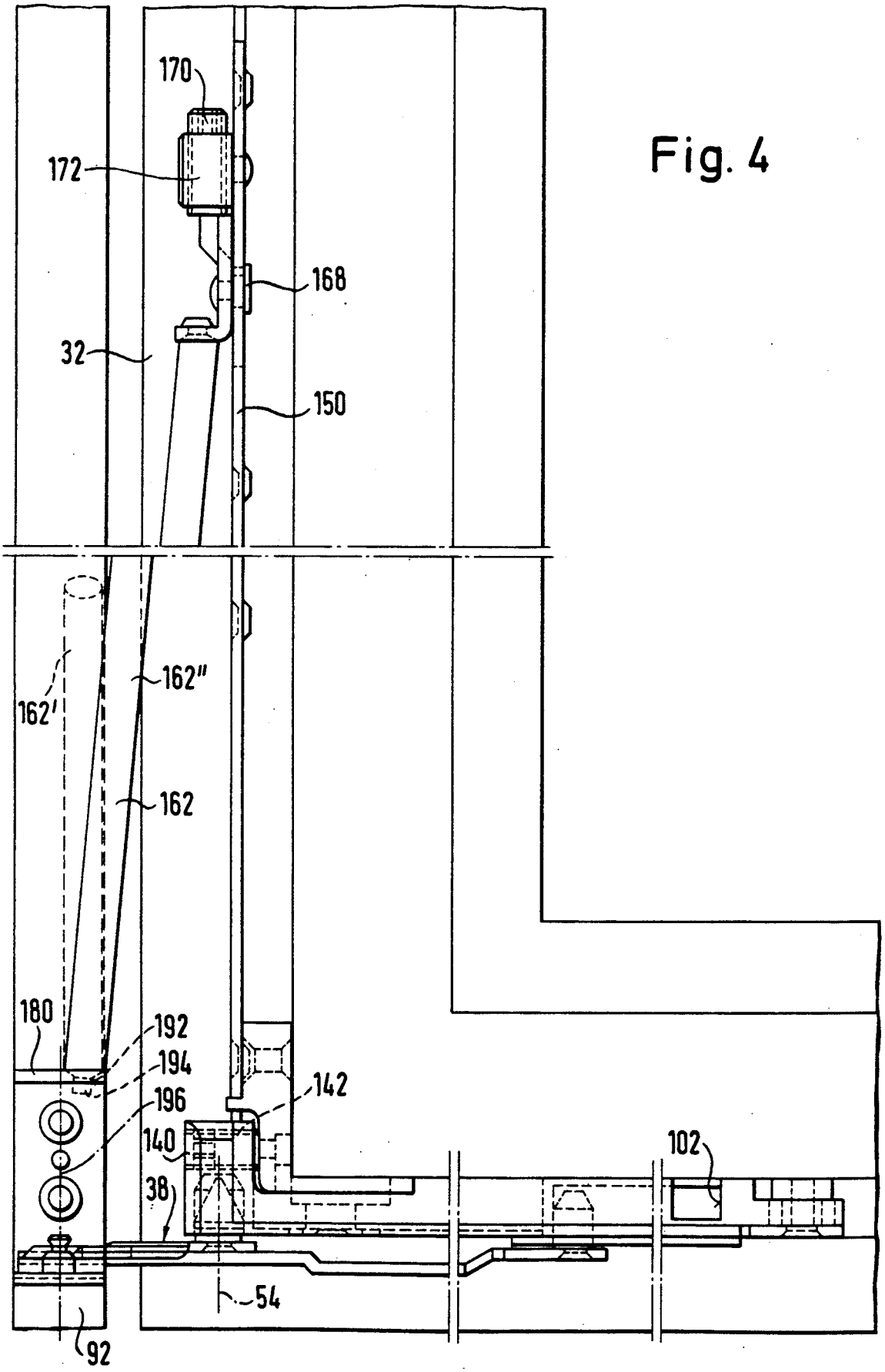
FIG. 4 is a view of the arrangement shown in FIG. 3 viewed in a direction according to the arrow IV when the leaf is pivoted into an open position.

In order to relieve the two link joints 38, of the weight of the leaf, particularly when the leaf is turned and tilted into an open position, a bracing device 160 is provided which is shown in FIGS. 3 and 4 and which acts between the leaf frame 26 and the fixed frame 20. This bracing device 160 consists of a bracing bar 162 which has its top end braced on a bracing angle member 164 on the leaf frame side while its bottom end is braced on the corner bearing angle member 90.

The bracing angle member 164 is mounted for displacement in a vertical direction on the vertical face plate 150. This is indicated in FIG. 3 by an elongated hole 166 in the face plate and which is traversed by a guide bolt 168 projecting in a horizontal direction from the bracing angle member 164. The top end of the vertical member of the bracing angle member 164 is supported on a setscrew 170 which in turn passes through a thrust bearing 172 rigidly mounted on the face plate 150. The bracing bar 162 is rigidly connected to the horizontal member 174 of the bracing angle member 164, particularly by being riveted. The said bolt 168 admits of a pivoting movement of the bracing angle member about the bolt axis 176. Such a pivoting movement occurs when the leaf is pivoted into an open position, as will be explained hereinafter.

The top end of the vertical member 178 of the corner bearing angle member 90 is constructed with an inwardly (in the direction of the leaf frame 26) angled-over bracing lug 180 which is in turn provided with a bore 192 to accommodate a journal 194 at the bottom end of the bracing bar 162. As FIG. 4 clearly shows, the bore 192 in the bracing lug 180 is laterally offset out of the longitudinal central plane 196 through the corner bearing angle 90 in the direction of the leaf frame. Furthermore, the journal 194 and/or the bore 192 is/are correspondingly conical to allow the tilting movement of the bracing bar 162 which occurs during pivoted opening of the leaf.

When the leaf is closed, the top end of the bracing bar 162 is substantially in the said longitudinal central plane 196. The slightly leftwardly inclined starting position 162' of the bracing bar indicated by the broken line in FIG. 4 results. If, now, the leaf is pivoted open, the bracing bar 162 finally pivots into the rightwardly inclined position 162'' shown on the right in FIG. 4, the bracing bar being in the meantime vertically orientated. The result is that upon pivoted opening of the leaf, the leaf frame supported on the bracing bar 160 performs an initially negligible lifting movement and then completes a negligible lowering movement. The two link joints 38 are thus relieved of the weight of the leaf.

The aforedescribed fitting is expediently assembled as follows:

The carrier part 92 is mounted in the bottom corner part of the leaf frame 26 by means of the appropriate fixing screws and via the bracing member 52 and the abutment angle member 120. At the same time, the face plate 150 with the bracing device 160 (bracing angle member 164 with bracing bar 162; thrust bearing 172 and adjusting screw 170) is at the same time fixed in the vertical outer step of the groove. It has been found ideal firstly to turn the setscrew 170 sufficiently downwardly to use up the adjustment path of the bracing angle member 164. The screw-on angle member 64 with the link joint 38 and the stay 72 are mounted on the upper horizontal frame member 16 of the fixed frame 20, that end of the stay which is on the leaf frame side but which is not shown firstly remaining disconnected from the top edge of the leaf. Then the corner frame angle 90 with the link joint 38 on the fixed frame side is assembled. Prior to insertion of the leaf frame 26, the bottom guide link 42 is pivoted out through about 60 to 90% so that the drive journal 100 is in front of the angled-over bracing lug 180 in a direction at right-angles to the plane of the drawing in FIG. 3.

Upon insertion of the leaf frame 26, then, the bracing bar 162 has its bottom journal 194 fitted into the bore 192 in the bracing lug 180 so that the leaf frame is then supported on the corner bearing angle member 90 through the bracing device 160.

By upwards rotation of the setscrew 170 in the thrust bearing 172, the leaf frame is lowered sufficiently that the drive journal 100 is inserted into the bore 98 and the drive journal 96 is fitted into the elongated hole recess 94. Then the stay 72 is mounted on the top edge of the leaf. This can be done by rotating a (not shown) hammer head on the end of the stay which is on the leaf frame side and which is fixed on a catch-locking tie member.

In the pivoted open position, the leaf frame can be adjusted by means of the adjusting screw 142. The angled-over thrust lug 180, in conjunction with the extension piece 140 opposite it in a downwards direction, forms a safeguard against the leaf frame being lifted out when in the tilted position.

By reason of the aforedescribed construction, therefore, control link and guide link are substantially relieved of the weight of the leaf. Upon closing, the leaf is positively pressed against the frame so that there is no need to provide on the stay projections which engage recesses in the frame or behind the frame. No additional locking arrangement is required in the region of the corner bearing. In the pivoted open position, the leaf can simply be lifted out for installation of maintenance purposes. On the other hand, in the tilted position, the leaf frame is protected from being lifted out. When the leaf is closed, the only one of the fitting parts which can be seen is the operating handle, which helps to improve the appearance. The two link joints only occupy a minimal space.

Figure 7:
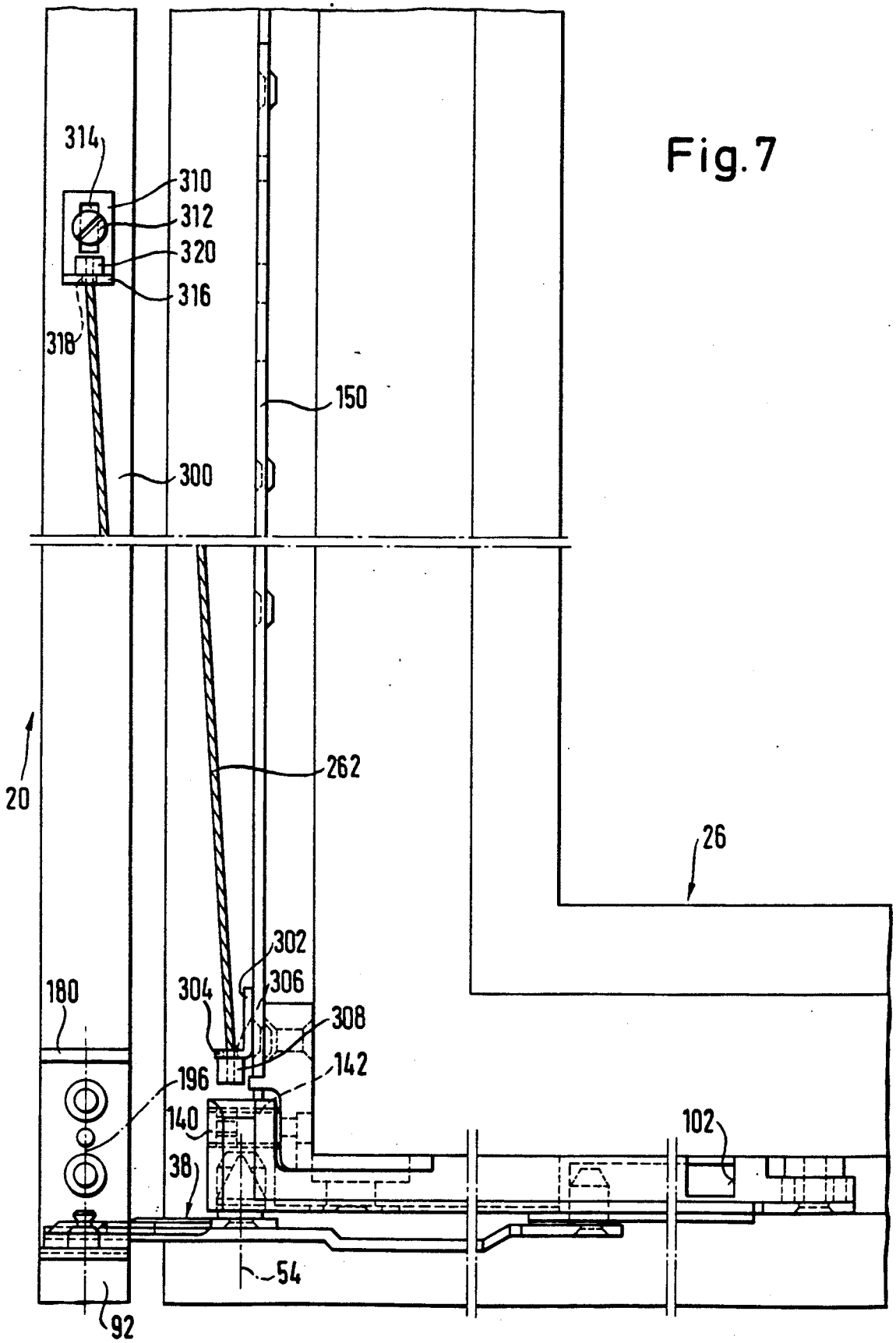
FIG. 7 is a view like FIG. 4 of a second embodiment.

FIG. 7 shows a second embodiment of the invention. The only difference as compared to the above-described embodiment is the exchange of the weight transferring element under compressive force (bracing bar 162) for a weight transferring element being under tensile force. This element is formed by a cable 262. The upper end of the cable is fixed to the vertical bar 300 of the fixed frame 20 e.g. at semi-height. The lower end of the cable 262 is fixed to the leaf frame 26 in the region of its bottom corner. To this end, an angle member 302 is fixed to the face plate 150. A lug 304 of the angle member 302 is horizontally protruding from the vertical face plate 150 and is provided with a hole 306 for the drawing cable 262. A clamp 308 fixed to the lower end of the cable 262 abuts the lower side of the lug 304 when the cable 262 is under tensioning force.

Likewise, an angle member 310 at the top end of the cable 262 is fixed to the fixed frame 20 e.g. by means of a screw 312 extending through a vertically elongated hole 314 of the angle member 310 to ensure vertical adjustment of the angle member 310. A horizontally protruding lug 316 of the angle member 310 is provided with a hole 318 adapted to the diameter of the cable 262. A clamp 320 or the like 320 fixed to the top end of the cable 262 abuts the upper side of the lug 316, the cable being drawn through the hole 318 and being under tensioning force according to the weight of the leaf frame 26. Thus, the bottom pivot bearing and the top pivot bearing are unloaded when pivoting the leaf frame 26 with respect to the fixed frame 20 about the vertical pivot axis 54, which axis is moving during this pivot movement.

I claim:

1. Pivoted fitting for windows or doors with a fixed frame (20) and a leaf frame (26) mounted on the fixed frame (20) to be rotatable about a vertical pivot axis (54), comprising a bottom pivot bearing which connects the fixed frame (20) to the leaf frame (26) in the region of a bottom corner of the fixed frame (20), a top pivot bearing (10) which connects the fixed frame (20) to the leaf frame (26) in the region of a top corner of the fixed frame (20), the two pivot bearings (10, 12) being in each case constructed with at least two links (40, 42) so that when the leaf frame (26) is pivoted open, the pivot axis (54) is shifted in a direction at right-angles to the plane of the fixed frame (20), wherein the leaf frame (26) is braced on the fixed frame (20) through a device (160) independent of the links (40, 42) of the two pivot bearings (10, 12), said device including a weight transferring element (162, 262) arranged in a vertically extending space between said fixed frame (20) and said leaf frame (26) on a pivot axis side of said frames, said weight transferring element (162, 262) having two ends, one of said ends being connected to said fixed frame (20) and the other of said ends being connected to said leaf frame (26) so as to transfer the weight of said leaf frame (26) to said fixed frame (20) in a pivoted-open position of said leaf frame (26) relative to said fixed frame (20).

2. Turn-and-tilt fitting for windows or doors with a fixed frame (20) and a leaf frame (26) mounted on the fixed frame (20) to be rotatable about a vertical pivot axis (54) and to be tiltable about a horizontal tilting axis, comprising a bottom pivot bearing in the form of a turn-and-tilt bearing (12) which connects the fixed frame (20) to the leaf frame (26) in the region of a bottom corner of the fixed frame (20), a top pivot bearing (10) which connects the fixed frame (20) to a stay (72) coupled to the leaf frame (26), in the region of an upper corner of the fixed frame (20), the two pivot bearings (10, 12) being in each case constructed with at least two links (40, 42) so that when the leaf frame (26) is pivoted open, the pivot axis (54) is shifted in a direction at right-angles to the plane of the fixed frame (20), wherein the leaf frame (26) is braced on the fixed frame (20) through a device (160) independent of the links (40, 42) of the two pivot bearings (10, 12), said device including a weight transferring element (162, 262) arranged in a vertically extending space between said fixed frame (20) and said leaf frame (26) on a pivot axis side of said frames, said weight transferring element (162, 262) having two ends, one of said ends being connected to said fixed frame (20) and the other of said ends being connected to said leaf frame (26) so as to transfer the weight of said leaf frame (26) to said fixed frame (20) in a pivoted-open position of said leaf frame (26) relative to said fixed frame (20).

3. A fitting according to claim 1 or 2, wherein said weight transferring element (162, 262) is elongated, and has an axis of elongation which extends in an essentially vertical direction in a closed position of said leaf frame (26) relative to said fixed frame (20).

4. A fitting according to claim 1 or 2, wherein said weight transferring element is arranged so as to be under tensile force exerted by the weight of said leaf frame (26) in said pivoted-open position of said leaf frame (26) relative to said fixed frame (20).

5. A fitting according to claim 4, wherein said weight transferring element is a cable (262).

6. A fitting according to claim 1 or 2, wherein said weight transferring element is arranged so as to be under a compression force exerted by the weight of said leaf frame (26) in said pivoted-open position of said leaf frame (26) relative to said fixed frame (20).

7. A fitting according to claim 6, wherein said weight transferring element is a bar (162).

8. A fitting according to claim 1 or 2, wherein said vertically extending space between said fixed frame (20) and said leaf frame (26) is closed in a closed position of said leaf frame (26) relative to said fixed frame (20).

9. A pivoted fitting for windows or doors with a fixed frame (20) and a leaf frame (26) which is mounted on the fixed frame (20) to be rotatable about a vertical pivot axis (54), comprising a bottom pivot bearing which connects the fixed frame (20) to the leaf frame (26) in the region of a bottom corner of the fixed frame (20), a top pivot bearing (10) which connects the fixed frame (20) to the leaf frame (26) in the region of a top corner of the fixed frame (20), the two pivot bearings (10, 12) being in each case constructed with at least two links (40, 42) so that when the leaf frame (26) is pivoted open, the pivot axis (54) is shifted in a direction at right-angles to the plane of the fixed frame (20), the two links of each pivot bearing intersecting each other and being articulatingly connected by a universal joint (44) at the point of intersection, one of the two links, the guide link (40), being connected to a pivot bearing part (64, 90) on the fixed frame side and to a pivot bearing part (92) on the leaf frame side, in each case via a swivel joint (48, 52) while the other link, the control link (42) is connected to the pivot bearing part (64, 90) on the fixed frame side and to the pivot bearing part (92) on the leaf frame side, in each case via a sliding swivel joint (58, 60), characterised in that when the leaf is closed, all the swivel joints (48, 52) and sliding swivel joints (58, 60) are at least approximately in a plane parallel with the plane of the frame, and in that in a region of the control link (42) between the universal joint (44) and one of the two swivel joints (48, 52), said control link (42) is constructed with a crank corresponding to the thickness of the guide link (40) in the direction of the pivot bearing part which carries the relevant swivel joint, and in that the guide link (40) is likewise constructed with a crank corresponding to the thickness of the control link but in the opposite direction which, when the leaf is closed, lies in the direction at right-angles to the plane of the frame, alongside the crank in the control link (42).

10. A tilt-and-turn fitting for windows or doors with a fixed frame (20) and a leaf frame (26) mounted on the fixed frame (20) to be rotatable about a vertical pivot axis (54) and to be tiltable about a horizontal tilting axis, comprising a bottom pivot bearing in the form of a turn-and-tilt bearing (12) which connects the fixed frame (20) to the leaf frame (26) in the region of a bottom corner of the fixed frame (20), a top pivot bearing (10) which connects the fixed frame (20) to a stay (72) coupled to the leaf frame (26), in the region of a top corner of the fixed frame (20), the two pivot bearings (10, 12) being in each case constructed with at least two links (40, 42) so that when the leaf frame (26) is pivoted open, the pivot axis (54) is shifted in a direction at right-angles to the plane of the fixed frame (20), the two links of each pivot bearing intersecting each other and being articulatingly connected by a universal joint (44) at the point of intersection, one of the two links, the guide link (40), being connected to a pivot bearing part (64, 90) on the fixed frame side and to a stay (72) in each case via a swivel joint (48, 52) while the other link, the control link (42), is connected to the pivot bearing part (64, 90) on the fixed frame side and to the stay (72) in each case via a sliding swivel joint (58, 60), characterised in that when the leaf is closed, all the swivel joints (48, 52) and sliding swivel joints (58, 60) are at least approximately in a plane parallel with the plane of the frame, and in that in a region of the control link (42) between the universal joint (44) and one of the two swivel joints (48, 52), said control link (42) is constructed with a crank corresponding to the thickness of the guide link (40) in the direction of the pivot bearing part which carries the relevant swivel joint and in that the guide link (40) is likewise constructed with a crank corresponding to the thickness of the control link but in the opposite direction which, when the leaf is closed, lies in the direction at right-angles to the plane of the frame, alongside the crank in the control link (42).

11. A fitting according to claim 9 or 10, characterised in that at least one of the two links is provided in the region of the relevant crank with a recess (74, 76) open in a direction at right-angles to the plane of the frame and intended to receive whichever is the other link.

12. A fitting according to claim 9 or 10, characterised in that the pivot bearing part (64, 90) on the fixed frame side is in the region of its sliding swivel joint (58) provided with a crank corresponding to the thickness of a bearing bolt head (70) and in that the control link (42) and the guide link (40) are in each case constructed with a substantially identical crank.

13. A fitting according to claim 10, characterised in that in the case of the tilt-and-turn bearing (corner bearing 12) there is in the region of that end of the control link (42) which is on the leaf frame side and of the guide link (40) an entraining journal (96, 100) which engages a corresponding journal receiving aperture (94, 98) in a bearer part (92) on the leaf frame side.

14. A fitting according to claim 13, characterised in that the entraining journal (100) tapers conically towards the end of the journal.

15. A fitting according to claim 13, characterised in that the bearer part (92) is constructed to be adjustable on the leaf frame (26) in a direction (A) parallel with the bottom horizontal member (28) of the leaf frame.

16. A fitting according to claim 15, characterised in that rigidly mounted at the corner of the leaf frame is an abutment angle member (120), the horizontal leg (124) of which is constructed with a sliding guide for the bearer part (92) while its vertical leg (122) is braced via a setscrew (142) on an expansion piece (140) of the bearer part (92).

17. Window or door, comprising a fixed frame (20), a leaf frame (26) mounted on the fixed frame (20), a bottom pivot bearing means (12) for coupling the fixed frame (20) to the leaf frame (26) in the region of a bottom corner of the fixed frame (20), a top pivot bearing means (10) for coupling the fixed frame (20) to the leaf frame (26) in the region of a top corner of the fixed frame (20), said top corner being arranged vertically above said bottom corner, said two pivot bearing means (10, 12) defining a vertical pivot axis (54) for rotatable movement of said leaf frame (26) relative to said fixed frame (20), said two pivot bearing means (10, 12) each comprising at least two connecting links (40, 42), said at least two connecting links each connecting said fixed frame (26) with said leaf frame (26) and shifting said pivot axis (54) relative to said fixed frame (20) during said rotatable movement of said leaf frame (26) relative to said fixed frame (20), a weight transferring device (160) coupled to said fixed frame (20) and to said leaf frame (26) and transferring the weight of the leaf frame (26) to said fixed frame (20) independent of the links (40, 42) of said two pivot bearings (10, 12), said device including a weight transferring element (162, 262) arranged in a vertically extending space between said fixed frame (20) and said leaf frame (26) on a pivot axis side of said frames, said weight transferring element (162, 262) having two ends, one of said ends being connected to said fixed frame (20) and the other of said ends being connected to said leaf frame (26) so as to transfer the weight of said leaf frame (26) to said fixed frame (20) in a pivoted-open position of said leaf frame (26) relative to said fixed frame (20).

18. Window or door according to claim 17, wherein said weight transferring element is a cable (262).

19. Window or door according to claim 17, wherein said weight transferring element is a bar (162).

20. Window or door according to claim 17, wherein said vertically extending space between said fixed frame (20) and said leaf frame (26) is defined by a chamber, said chamber being closed in a closed position of said leaf frame (26) relative to said fixed frame (20).

21. Window or door according to claim 20, wherein said chamber extends between a vertical frame member (24) of said leaf frame (26) and a vertical frame member (18) of said fixed frame (20) on said pivot side of said frames (26, 20).

22. Window or door, comprising:

a fixed frame (20);

a leaf frame (26) mounted on the fixed frame (20);

a bottom pivot bearing means (12) for coupling the fixed frame (20) to the leaf frame (26) in the region of a bottom corner of the fixed frame (20);

a top pivot bearing means (10) for coupling the fixed frame (20) to the leaf frame (26) in the region of a top corner of the fixed frame (20), said top corner being arranged vertically above said bottom corner, said two pivot bearing means (10, 12) defining a vertical pivot axis (54) for rotatable movement of said leaf frame (26) relative to said fixed frame (20), said two pivot bearing means (10, 12) each comprising at least two connecting links (40, 42), said at least two connecting links each connecting said fixed frame (26) with said leaf frame (26) and shifting said pivot axis (54) relative to said fixed frame (20) during said rotatable movement of said leaf frame (26) relative to said fixed frame (20); and a weight transferring device (160) coupled to said fixed frame (20) and to said leaf frame (26) so as to transfer the weight of the leaf frame (26) to said fixed frame (20) independent of the links (40, 42) of said two pivot bearings (10, 12), said weight transferring device comprising a weight transferring element acting between said leaf frame and said fixed frame, said weight transferring element being under tensile force exerted by the weight of said leaf frame.

23. Window or door according to claim 22, wherein said weight transferring element is formed by a cable (262).

24. Pivoted frame for windows or doors with a fixed frame (20) and a leaf frame (26) mounted on the fixed frame to be rotatable about a vertical pivot axis (54), comprising:

a bottom pivot bearing which connects the fixed frame (20) to the leaf frame (26) in the region of a bottom corner of the fixed frame (20); and a top pivot-bearing (10) which connects the fixed frame (20) to the leaf frame (26) in a region of a top corner of the fixed frame (20), the two pivot bearings (10, 12) being in each case constructed with at least two links (40, 42) so that when the leaf frame (26) is pivoted open, the pivot axis (54) is shifted in a direction at right-angles to the plane of the fixed frame (20), wherein the leaf frame (26) is braced on the fixed frame (20) through a device (160) independent of the links (40, 42) of the two pivot bearings (10, 12), the device (160) comprising a bracing bar (162) supported at one end on the fixed frame (20) in the region of the bottom pivot bearing and at the other end on a frame member (24) of the leaf frame (26) which is closest to said bottom pivot bearing and which is parallel with the pivot axis (54).

25. Turn-and-tilt fitting for windows or doors with a fixed frame (20) and a leaf frame (26) mounted on the fixed frame (20) to be rotatable about a vertical pivot axis (54) and to be tiltable about a horizontal tilting axis, comprising:

a bottom pivot bearing in the form of a turn-and-tilt bearing (12) which connects the fixed frame (20) to the leaf frame (26) in the region of a bottom corner of the fixed frame (20); and a top pivot bearing (10) which connects the fixed frame (20) to a stay (72) coupled to the leaf frame (26), in the region of an upper corner of the fixed frame (20), the two pivot bearings (10, 12) being in each case constructed with at least two links (40, 42) so that when the leaf frame (26) is pivoted open, the pivot axis (54) is shifted in a direction at right angles to the plane of the fixed frame (20), wherein the leaf frame (26) is braced on the fixed frame (20) through a device (160) independent of the links (40, 42) of the two pivot bearings (10, 12), the device (160) comprising a bracing bar (162) supported at one end on the fixed frame (20) in the region of the bottom pivot bearing and at the other end on a frame member (24) of the leaf frame (26) which is closest to said bottom pivot bearing and which is parallel with the pivot axis.

26. A fitting according to claim 24 or 25, characterised in that the bracing bar (162) is braced on an angled-over bracing lug (180) on a corner bearing part on the frame side.

27. A fitting according to claim 26, characterised in that when the leaf frame is closed, the bracing lug (180) is, in the direction of the pivot axis (54), opposite an extension piece (140) disposed in the region of the corresponding bottom leaf frame corner.

28. A fitting according to claim 26, characterised in that at its bottom end the bracing bar (162) has a journal (194) adapted to be inserted into a bore (192) in the bracing lug (180).

29. A fitting according to claim 26, characterised in that the bracing bar (162) is braced on a location on the bottom pivot bearing which is offset in the direction of the leaf frame (26) out of a median plane (196) of the bottom pivot bearing which is parallel with the plane of the fixed frame.

30. A fitting according to claim 24 or 25, characterised in that the bracing bar (162) is braced on an angle member (164) mounted on a leaf frame face plate (150).

31. A fitting according to claim 30, characterised in that the angle member (164) is constructed to be adjustable in a direction parallel with the pivot axis (54).

32. A fitting according to claim 31, characterised in that the angle member (164) is braced on a setscrew (170).

33. A fitting according to claim 30, characterised in that the angle member (164) is rotatably mounted.

34. A fitting according to claim 33, characterised in that the bracing bar (162) is mounted in captive fashion on the angle member (164).

* * * * *